United States Patent [19]

Kohler et al.

[11] 4,123,298

[45] Oct. 31, 1978

[54] POST DECARBURIZATION ANNEAL FOR CUBE-ON-EDGE ORIENTED SILICON STEEL

[75] Inventors: Dale M. Kohler, Middletown; Norris A. Dahlstrom, Hamilton; David W. Taylor, Middletown, all of Ohio

[73] Assignee: Armco Steel Corporation, Middletown, Ohio

[21] Appl. No.: 759,326

[22] Filed: Jan. 14, 1977

[51] Int. Cl.[2] ..... H01F 1/04

[52] U.S. Cl. ..... 148/111; 148/112; 148/113

[58] Field of Search ..... 148/110, 111, 113, 31.55, 148/112; 75/123 L

[56] References Cited

U.S. PATENT DOCUMENTS

| | | | |
|---|---|---|---|
| 3,764,407 | 10/1973 | Hirano et al. | 148/112 |
| 3,930,906 | 1/1976 | Irie et al. | 148/113 |
| 3,932,234 | 1/1976 | Imanaka et al. | 148/112 |
| 3,954,521 | 5/1976 | Malagari | 148/111 |
| 4,000,015 | 12/1976 | Malabari | 148/112 |
| 4,030,950 | 6/1977 | Shilling et al. | 148/112 |
| 4,054,471 | 10/1977 | Datta | 148/112 |

*Primary Examiner*—W. Stallard

*Attorney, Agent, or Firm*—Melville, Strasser, Foster & Hoffman

[57] ABSTRACT

A high temperature continuous strip anneal is added to the routings for both high permeability cube-on-edge oriented silicon steel having a permeability at 796 A/m of more than about 1850 and regular cube-on-edge oriented silicon steel having a permeability at 796 A/m of less than about 1850. For both grades of cube-on-edge oriented silicon steel the high temperature anneal is performed after the decarburization step and before the final high temperature box anneal during which the final desired orientation and magnetic characteristics are achieved. The post decarburization anneal results in improvements in both permeability and core loss.

3 Claims, No Drawings

POST DECARBURIZATION ANNEAL FOR CUBE-ON-EDGE ORIENTED SILICON STEEL

BACKGROUND OF THE INVENTION

1. Field of the Invention

The invention relates to the addition of a high temperature continuous strip anneal to routings for cube-on-edge oriented silicon steel and more particularly to such a high temperature continuous strip anneal performed after the decarburization step and before the final high temperature box anneal.

2. Description of the Prior Art

The present invention is directed to improvements in the manufacture of cube-on-edge oriented silicon steel. In cube-on-edge oriented silicon steel the body-centered cubes making up the grains or crystals are oriented in the cube-on-edge position, designated (110) [001] in accordance with Miller's indices.

Cube-on-edge oriented silicon steels are well known in the art and are commonly used in the manufacture of transformer cores and the like. In recent years prior art workers have devised various routings for the manufacture of cube-on-edge oriented silicon steel which have resulted in markedly improved magnetic characteristics. As a result, such oriented silicon steels are now considered to fall into two general categories. The first category is generally referred to as high permeability grain oriented silicon steel and is made by routings which consistently produce a product having a permeability at 796 A/m of greater than about 1850 and typically greater than about 1900. The second category is generally referred to as regular grain oriented silicon steel and is made by those routings normally producing a permeability of less than about 1850. U.S. Pat. Nos. 3,287,183; 3,636,579; 3,873,381 and 3,932,234 are typical of those which teach routings for high permeability grain oriented silicon steel. U.S. Pat. No. 3,764,406 is typical of those which set forth routings for regular grain oriented silicon steel.

The present invention is based upon the discovery that irrespective of the routing used, if the silicon steel is subjected to a high temperature strip anneal after decarburization and before the final box anneal, marked improvements will be obtained in both permeability and core loss. The teachings of the present invention are applicable to the manufacture of both high permeability grain oriented silicon steel and regular grain oriented silicon steel, the high temperature strip anneal being conducted within the parameters set forth hereinafter.

SUMMARY OF THE INVENTION

To routings for both high permeability grain oriented silicon steel and regular grain oriented silicon steel the present invention contemplates the addition of a high temperature continuous strip anneal. For both grades of cube-on-edge oriented silicon steel, the high temperature strip anneal is performed after decarburization and before the final high temperature box anneal during which the final desired orientation and magnetic characteristics are achieved.

For high permeability grain oriented silicon steel the strip anneal is conducted at a temperature of from about 950° C. to about 1175° C. for from about 15 seconds to about 5 minutes. The time of the anneal bears an inverse relationship to the temperature. In a preferred range, the anneal is conducted at a temperature of from about 1050° C. to about 1100° C. for a time of from about 30 seconds to about 1 minute.

In the manufacture of regular grain oriented silicon steel, the anneal of the present invention is conducted at a temperature of from about 925° C. to about 1100° C. at a time of from about 15 seconds to about 10 minutes. Again, the time bears an inverse relationship to the temperature. For regular grain oriented silicon steel, the preferred ranges of time and temperature for the strip anneal are from about 925° C. to about 1070° C. for a time of from about 30 seconds to about 5 minutes.

For both grades of silicon steel the strip anneal of the present invention should be conducted in an atmosphere which will not create surface conditions on the silicon steel which would interfere with application of an annealing separator, interaction of the annealing separator and the silicon steel, or the formation of a mill glass. Exemplary atmospheres comprise pure nitrogen, pure hydrogen, nitrogen-hydrogen combinations, inert gases, decarburizing atmospheres and the like.

Following decarburization (i.e. reducing the carbon content of the silicon steel to below about 0.010% and preferably below about 0.003%), for either type of grain oriented silicon steel the steel may be allowed to cool and the anneal may be performed thereafter. Preferably, however, in both instances it is desired to conduct the high temperature strip anneal of the present invention upon the silicon steel while still hot from the decarburization step, for reasons of economy. This can be accomplished in a separate strip anneal furnace following a decarburizing furnace or in the decarburizing furnace itself or an extension thereof, containing any of the atmospheres listed above.

DESCRIPTION OF THE PREFERRED EMBODIMENTS

The U.S. Patents listed above as relating to high permeability grain oriented silicon steel teach various routings for its manufacture. The teachings of the present invention are not dependent upon the selection of a particular routing. As a non-limiting example, the silicon steel may have a melt composition in weight percent as follows:

Si: 2%–4%
C: less than 0.085%
Al (acid-soluble): 0.01%–0.065%
N: 0.003%–0.010%
Mn: 0.03%–0.2%
S: 0.015%–0.07%

The above list includes only the primary constituents. As will be understood by one skilled in the art, the melt may include minor amounts of copper, phosphorous and oxygen together with those impurities incident to the mode of manufacture.

In an exemplary routing the melt may be cast into ingots and rolled to slabs or continuously cast in slab form. The slab is reheated to a temperature of about 1400° C. and is hot rolled to hot band thickness. After hot rolling, the steel band is continuously annealed at a temperature of from about 850° C. to about 1200° C. for from about 30 seconds to about 60 minutes in an atmosphere of combusted gas, nitrogen, air or inert gas. The strip is thereafter subjected to slow cooling to a temperature of from about 850° C. to about 980° C. followed by quenching to ambient temperature.

After descaling and pickling, the steel is cold rolled in one or more stages to final gauge, the final cold reduction being from about 65% to about 95%. Thereafter, the steel is continuously decarburized in wet hydrogen at a temperature of about 830° C. for about 3 minutes at a dew point of about 60° C. Thereafter, the decarburized silicon steel is provided with an annealing separator such as a magnesia coating and is subjected to a final box anneal in an atmosphere of hydrogen, at a temperature of about 1200° C.

In routings such as the exemplary one stated above, permeabilities are achieved above about 1850 at 796 A/m through the combined action of manganese sulfides and aluminum nitrides which, during the final box anneal inhibit primary grain growth and thus promote secondary grain growth to achieve the desired orientation. Other grain growth inhibitors or combinations of inhibitors may be used, as is well known in the art.

In accordance with the teachings of the present invention, irrespective of the precise steps comprising the routing used in the manufacture of the high permeability grain oriented silicon steel, the steel is subjected to a continuous strip anneal following the decarburization step and preferably prior to the application of an annealing separator in preparation for the final high temperature box anneal. The strip is annealed at a temperature of from about 950° C. to about 1175° C. for a time of from about 15 seconds to about 5 minutes. The time of the anneal bears an inverse relationship to the temperature. Thus if a temperature is chosen from the lower end of the above given range, the time should be chosen from the upper end of the above given time range and vice versa. A preferred time temperature range is from about 1050° C. to about 1100° C. for from about 30 seconds to about 1 minute.

When such an anneal is practiced, the final product will demonstrate improvements in permeabilities up to 30 points or more at 796 A/m and in core loss up to 0.10 w/kg or more at 1.7 T. While the permeability and core loss improvements may vary in amount from coil-to-coil, the practice of the present invention will provide a definite improvement in magnetic properties irrespective of the routing used. The mechanism by which the magnetic properties improve as a result of the practice of the strip anneal of the present invention are not fully understood. Samples demonstrating marked increase in permeability and decrease in core loss have generally been found to have demonstrated less than 5% secondary grain growth following the strip anneal of the present invention. While not wishing to be bound by theory, it is believed that the superior magnetic properties of the post decarburization annealed samples results from the improvement in the orientation of the secondary grains, rather than in refinement in their size. It may also be true that the post decarburization anneal brings about improvement in the form and distribution of the manganese sulfide and aluminum nitride inhibitors.

In the manufacture of regular grain oriented silicon steel a typical melt composition by weight percent may be stated as follows:

C: less than 0.085%
Si: 2%–4%
S and/or Se: 0.015%–0.07%
Mn: 0.02%–0.02%

The balance being iron and those impurities incident to the mode of manufacture.

In a typical but nonlimiting routing, the melt may be cast into ingots and reduced to slabs or continuously cast in slab form. Again, the slabs may be reheated to a temperature of about 1400° C. and hot rolled to hot band thickness. The hot band is annealed at a temperature of about 980° C. and pickled. Thereafter, the silicon steel may be cold rolled in one or more stages to final gauge and decarburized at a temperature of about 815° C. for a time of about 3 minutes in a wet hydrogen atmosphere with a dew point of about 60° C. The decarburized silicon steel is thereafter provided with an annealing separator such as a coating of magnesia and subjected to a final high temperature box anneal wherein the desired final orientation and magnetic characteristics are developed. The box anneal may be conducted in an atmosphere such as dry hydrogen at a temperature of about 1200° C.

In the preparation of regular grain oriented silicon steel the desired final orientation is achieved through the agency of manganese sulfides or manganese selenides depending upon whether sulfur or selenium was added to the initial melt composition. During the final box anneal the manganese sulfides or selenides (or a combination of the two inhibit primary grain growth and thus promote secondary grain growth to achieve the desired final orientation. To assure that sufficient inhibitor is present, it is possible to add inhibitor at or immediately prior to the final anneal, as is taught in the above mentioned U.S. Pat. No. 3,333,992.

To an exemplary routing such as the one given above, the present application contemplates the addition of a continuous strip anneal following decarburization and preferably prior to the provision of an annealing separator for the silicon steel in preparation for the final high temperature box anneal. The anneal is conducted at a temperature of from about 925° C. to about 1100° C. for a time of from about 15 seconds to about 10 minutes. As in the case of the high permeability grain oriented silicon steel, the time bears an inverse relationship to the temperature. Preferred time and temperature ranges are from about 925° C. to about 1070° C. for a time of from about 30 seconds to about 5 minutes. When such an anneal is practiced, a core loss improvement of up to 0.035 w/kg or more at 1.7T may be achieved and permeability at 796 A/m may improve up to eight points or more.

As in the case of the high permeability grain oriented silicon steel, the mechanism for the improvements in permeability and core loss when the anneal of the present invention is applied to regular grain oriented silicon steel is not fully understood. In general, the improvements achieved with regular grain oriented silicon steel in both permeability and the core loss are not as marked as those achieved with respect to high permeability grain oriented silicon steel. If the mechanism involves some small change in size, shape or distribution of the inhibiting precipitates during the post decarburizing anneal, it may be that previous anneals in the routing have put the manganese sulfide or selenide precipitates more nearly in optimum form and distribution prior to the post decarburizing anneal.

In both the manufacture of high permeability grain oriented silicon steel and regular grain oriented silicon steel the silicon steel may be allowed to cool between the decarburization step and the post decarburization anneal. Preferably, and for reasons of economy, the post decarburizing anneal should be performed immediately after the decarburizing step (i.e. reducing the carbon content of the silicon steel to below about 0.010% and preferably below about 0.003%) to take advantage of the temperature of the silicon steel as a result of the decarburizing step. This can be accomplished in a separate strip anneal furnace following a decarburizing furnace or in the decarburizing furnace itself or an extension thereof, containing any of the atmospheres listed above.

Examples illustrating the present invention are as follows:

EXAMPLE I

Three heats of silicon steel were melted in an electric furnace, cast, and processed into high permeability grain oriented silicon steel strip. The chemistries of the heats are given in Table I below.

TABLE I

| | COMPOSITION (WEIGHT PERCENT) | | | | | |
|---|---|---|---|---|---|---|
| Heat | C | Mn | S | Si | Al | N |
| A | .053 | .099 | .024 | 2.98 | .033 | .0079 |
| BB | .045 | .090 | .027 | 2.87 | .034 | .0061 |
| C | .042 | .096 | .025 | 2.86 | .027 | .0080 |

Silicon steel from these heats was processed in two different groups to demonstrate the effect that the high temperature strip anneal of the present invention has on the magnetic properties of high permeability cube-on-edge oriented silicon steel. In Group I, 152 mm thick slabs were reheated at 1400° C. and hot rolled to a thickness of 2.3 mm. The hot rolled material was strip annealed at 1120° C. for two minutes, cooled to 930° C. in 20 seconds and water quenched to 25° C. in 20 seconds. The silicon steel was thereafter cold rolled to about 0.345 mm and decarburized in wet hydrogen for 3 minutes at 830° C. at a dew point of 60° C.

Samples of the silicon steel of Group I were coated with MgO and given a final high temperature anneal at 1200° C. for 30 hours.

The silicon steel of Group II was processed in the same manner as that of Group I except that samples in the laborabory were subjected to the strip anneal of the present invention after decarburization and before the application of the MgO annealing separator. The strip anneal was conducted at 1120° C. for 40 seconds in a nitrogen atmosphere.

The magnetic properties in the rolling direction for both groups are given in Table II below.

TABLE II

| | GROUP I | | GROUP II | |
|---|---|---|---|---|
| HEAT | CORE LOSS AT 1.7T (60Hz) | PERMEA- AT 796 A/m | CORE LOSS AT 1.7% (60Hz) | PERMEA- AT 796 (A/m |
| A | 1.733 w/kg | 1890 | 1.691 w/kg | 1894 |
| B | 1.788 w/kg | 1902 | 1.702 w/kg | 1910 |
| C | 1.812 w/kg | 1898 | 1.735 w/kg | 1903 |

EXAMPLE II

A heat of silicon steel was melted in an electric furnace, cast, and processed into high permeability grain oriented silicon steel strip. The chemistry of the heat is given in Table III below.

TABLE III

| COMPOSITION (WEIGHT PERCENT) | | | | | | | | | | | |
|---|---|---|---|---|---|---|---|---|---|---|---|
| C | Mn | S | Si | Al | N | Cu | Ti | P | O | Cr | Sn |
| .043 | .093 | .024 | 2.88 | .032 | .0058 | .096 | .0027 | .005 | .0023 | .041 | .010 |

The heat was processed as follows. Slabs of 152 mm thickness were reheated at 1400° C. The silicon steel was hot rolled to 2.3 mm; strip annealed at 1120° C. for 2 minutes; cooled to 930° C. in 20 seconds; water quenched to 25° C. in 20 seconds; cold rolled to 0.294 mm and decarburized for 3 minutes at 830° C. in wet hydrogen at a dew point of 60° C.

Samples of the silicon steel were subjected to strip anneals, according to the present invention, in a nitrogen atmosphere at different temperatures and for different times to help determine the optimum for this anneal. Thereafter the samples were coated with a MgO annealing separator and subjected to a final anneal at 1200° C. for 24 hours. The magnetic properties in the rolling direction are given for the samples in Table IV below.

TABLE IV

| STRIP ANNEAL | Core Loss At 1.7T (60Hz) | Permeability At 796 A/m |
|---|---|---|
| None | 1.435/kg | 1927 |
| 15 sec. at 1066° C. | 1.440 | 1923 |
| 30 sec. at 1066° C. | 1.429 | 1937 |
| 1 min. at 1066° C. | 1.378 | 1934 |
| 5 min. at 1066° C. | 1.640 | 1854 |
| 1 min. at 1204° C. | 2.674 | 1520 |

EXAMPLE III

A heat of silicon steel was melted in an electric furnace, cast, and processed into regular grain oriented silicon steel strip. The ladle chemistry of the heat is given in Table V below

TABLE V

| COMPOSITION (WEIGHT PERCENT) | | | | | | | |
|---|---|---|---|---|---|---|---|
| C | Mn | S | Si | Al | N | Cu | Ti |
| .028 | .048 | .023 | 3.10 | .002 | .0039 | .085 | .0026 |

As in Example I, silicon steel from this heat was processed in two groups to demonstrate the effect the high temperature strip anneal of the present invention has on the magnetic properties of regular grain oriented silicon steel. Group I was formed into slabs of 152 mm thickness which were reheated at 1400° C. Thereafter, the silicon steel was hot rolled to 2.0 mm; strip annealed at 925° C. for 40 seconds; cold rolled to 0.65 mm; strip annealed at 925° C. for 40 seconds; cold rolled to 0.345 mm. and decarburized for 2½ minutes at 825° C. in wet hydrogen at a dew point of 60° C.

Samples of the Group I silicon steel were coated with a MgO annealing separator and final annealed at 1200° C. for 30 hours.

The Group II silicon steel was processed in the same manner with the exception that the samples were subjected to a strip anneal in accordance with the teachings of the present invention. The silicon steel was annealed at 1010° C. for 5 minutes in an atmosphere of nitrogen after decarburizing and before application of the MgO annealing separator.

For the silicon steel of Group I the core loss (1.7T) was 1.922 w/kg and the permeability at 796 A/m was 1823. For the silicon steel of Group II the core loss (1.7T) was 1.887 w/kg and the permeability at 796 A/m was 1828. The superiority of the magnetic properties of the Group II silicon steel is attributed to the high temperature strip anneal of the present invention.

EXAMPLE IV

Two heats of silicon steel were melted in an electric furnace, cast, and processed into high permeability silicon steel strip. The chemistries of the heats are given in Table VI below.

TABLE VI

| | COMPOSITION (WEIGHT PERCENT) | | | | | | | | | | | |
|---|---|---|---|---|---|---|---|---|---|---|---|---|
| Heat | C | Mn | S | Si | Al | N | Cu | Ti | P | O | Sn | Cr |
| D | .046 | .090 | .028 | 2.88 | .027 | .0062 | 11 | .0029 | .005 | .0026 | .010 | .046 |
| E | .042 | .11 | .025 | 2.90 | .024 | .0058 | .075 | .0028 | .004 | .0018 | .003 | .048 |

The silicon steel of both heats was formed into slabs 152 mm thick, reheated at 1400° C. and hot rolled to 2.3 mm.

The hot rolled material was used to make up three test groups, (each group containing silicon steel from both heats), to demonstrate that the high temperature strip anneal of the present invention can improve magnetic properties for such steel given a variety of strip anneals following hot rolling.

The silicon steel of Group I was strip annealed at 1120° C.; cooled to 930° C. in 20 seconds; and water quenched to 25° C. in 20 seconds.

The silicon steel of Group II was strip annealed at 1010° C.; cooled to 820° C. in 20 seconds and water quenched to 25° C. in 20 seconds.

The silicon steel of Group III was strip annealed at 899° C.; cooled to 700° C. in 20 seconds; and water quenched to 25° C. in 20 seconds.

The silicon steel of all three groups was thereafter cold rolled to a thickness of 0.294 mm and decarburized for 3 minutes in wet hydrogen at 830° C. at a dew point of 60° C. Some samples from each group were then coated with a MgO annealing separator and final anneal at 1200° C. for 30 hours. Other samples from the three groups were similarly processed with the exception that they were subjected to strip anneals in a nitrogen atmosphere in accordance with the teachings of the present invention. The strip anneals were conducted after decarburization and prior to the application of the annealing separator. Table VII sets forth the nature of the post decarburization anneals and the magnetic properties of the samples.

TABLE VII

| Heat | Post Decarb. Anneal | Permeability At 796 A/m |
|---|---|---|
| Group I | | |
| D | None | 1891 |
| D | 2 min. at 1066° C. | 1938 |
| E | None | 1852 |
| E | 2 min. at 1066° C. | 1915 |
| Group II | | |
| D | None | 1879 |
| D | 2 min. at 1093° C. | 1907 |
| E | None | 1842 |
| E | 2 min. at 1093° C. | 1893 |
| Group III | | |
| D | None | 1861 |
| D | 2 min. at 1093° C. | 1881 |
| E | None | 1820 |
| E | 2 min. at 1093° C. | 1883 |

From the above examples it is readily apparent that the post decarburization anneal of the present invention results in improvements in both core loss and permeability. The improvements are more marked in high permeability grain oriented silicon steel than in regular grain oriented silicon steel.

Modifications may be made in the invention without departing from the spirit of it.

The embodiments of the invention in which an exclusive property or privilege is claimed are defined as follows:

1. In a process of producing grain oriented silicon steel chosen from the class consisting of cube-on-edge oriented silicon steel having a permeability at 796 A/m of more than about 1850 and cube-on-edge oriented silicon steel having a permeability at 796 A/m of less than about 1850 and including the steps of hot rolling to hot band thickness, annealing, pickling, cold rolling to final gauge, decarburizing and subjecting the decarburized silicon steel to a final box anneal during which the final desired cube-on-edge orientation is achieved, the improvement comprising the step of subjecting the silicon steel to a continuous high temperature strip anneal after decarburization and prior to said final box anneal, conducting said continuous high temperature strip anneal in an atmosphere chosen from the class consisting of pure nitrogen, pure hydrogen, nitrogenhydrogen combinations, inert gases and decarburizing atmospheres to improve both the permeability and core loss of said silicon steel, conducting said continuous high temperature strip anneal, when producing said cube-on-edge oriented silicon steel having a permeability at 796 A/m of more than about 1850, at a temperature of from about 950° C. to about 1175° C. for a time of from about 15 seconds to about 5 minutes, said time bearing an inverse relationship to said temperature, and conducting said continuous high temperature anneal, when producing said cube-on-edge oriented silicon steel having a permeability at 796 A/m of less than about 1850, at a temperature of from about 925° C. to about 1100° C. for a time of from about 15 seconds to about 10 minutes, said time again bearing an inverse relationship to said temperature.

2. The process claimed in claim 1 wherein said strip anneal is conducted at a temperature of from about 1050° C. to about 1100° C. for a time of from about 30 seconds to about 1 minute when producing said cube-on-edge oriented silicon steel having a permeability at 796 A/m of more than about 1850.

3. The process claimed in claim 1 wherein said strip anneal is conducted at a temperature of from about 925° C. to about 1070° C. for a time of from about 30 seconds to about 5 minutes when producing said cube-on-edge oriented silicon steel having a permeability at 796 A/m of less than 1850.

* * * * *